US005639091A

United States Patent [19]

Morales

[11] Patent Number: 5,639,091

[45] Date of Patent: Jun. 17, 1997

[54] INTEGER CARDS

[76] Inventor: Ysela Morales, 715 W. St. Charles, Brownsville, Tex. 78520

[21] Appl. No.: 649,332

[22] Filed: May 21, 1996

[51] Int. Cl.[6] ..... A63F 1/00

[52] U.S. Cl. ..... 273/299

[58] Field of Search ..... 273/292, 299, 273/302, 303, 304, 305; 434/205, 209, 188

[56] References Cited

U.S. PATENT DOCUMENTS

| | | | |
|---|---|---|---|
| 1,115,441 | 10/1914 | Lake | 273/299 |
| 1,699,629 | 1/1929 | Phifer | 273/299 X |
| 2,198,670 | 4/1940 | Johnson | 273/299 |
| 2,769,640 | 11/1956 | Elder | 434/209 |
| 4,173,834 | 11/1979 | Arzola | 434/209 |
| 4,281,835 | 8/1981 | Seiden | 273/299 |
| 4,379,700 | 4/1983 | Pollock | 273/299 X |
| 4,512,746 | 4/1985 | Turner | 434/209 |
| 5,033,754 | 7/1991 | Finch | 273/299 |
| 5,067,725 | 11/1991 | Leach | 273/299 X |
| 5,242,171 | 9/1993 | Hata | 434/209 |
| 5,451,062 | 9/1995 | Malone | 273/299 X |

FOREIGN PATENT DOCUMENTS

| | | | |
|---|---|---|---|
| 1461664 | 12/1966 | France | 273/299 |
| 5811 | 10/1915 | United Kingdom | 273/299 |

*Primary Examiner*—William E. Stoll

*Attorney, Agent, or Firm*—Patent & Trademark Services; Joseph H. McGlynn

[57] ABSTRACT

A card game apparatus for use in educating children in basic mathematical concepts. The deck consists of 52 cards, each containing integers between −6 and +6. There are four "suits", each being a different arithmetic operation symbol (e.g., addition, multiplication, etc.). Two of the suits are one color (red), and two another (black). The cards may be used in a variety of games, differing in complexity depending on the needs of the students. The cards can be used to instruct students in concepts ranging from simple matching to more complex arithmetic calculations. Unlike the prior art, the present invention also highlights such basic concepts as positive and negative value and sequential ordering of integers.

1 Claim, 1 Drawing Sheet

INTEGER CARDS

BACKGROUND OF THE INVENTION

The present invention relates generally to an educational mathematics game apparatus, and particularly to a card game apparatus designed to teach children various mathematical concepts using a predetermined sequence of positive and negative integers.

DESCRIPTION OF THE PRIOR ART

The prior art has disclosed a number of educational games designed to teach children various mathematical concepts. The better part of these games have been aimed at teaching children, often through the use of cards, the concepts of addition, subtraction, multiplication, and division. U.S. Pat. Nos. 2,769,640, 4,173,834, 4,512,746, and 5,242,171 provide some examples of the multitude of card games aimed at educating youngsters about these basic arithmetic operations.

However, the prior art games have focused only on operations involving positive numbers, and thus have failed to educate children about the even more basic concepts of matching, consecutive ordering, negativity, and absolute value. Moreover, the number of different games that can be played with the prior art game apparatuses is often very limited. Thus, they are limited in terms of the number of different learning levels they can accommodate, as well as in the fun and variety they offer the child.

SUMMARY OF THE INVENTION

The present invention consists of a card game apparatus that is capable of teaching children many basic concepts involving integers. The cards can be used to play a large variety of games, ranging from simple matching tasks to more complex games involving multiplication and division. Thus, the teacher can use the cards over a wide range of instruction levels, and will be able to hold the interest of the children for longer periods by offering them a multitude of different activities.

The game apparatus of the present invention is a deck of 52 cards, consisting of four sets of cards, each marked with the integers −6 through −6, inclusive. Each set contains a notation indicating a different arithmetic operation; thus, one set indicates addition, another subtraction, still another multiplication, and finally, division. Two of the sets, moreover, contain red numerals, and two black.

As described more fully below, the game apparatus offers a wide range of different activities that teach children mathematical concepts at various levels of difficulty. For example, the cards can be used for simple matching tasks, which are suitable at the kindergarten and preschool level. They may also be used to play games involving consecutive ordering of integers that require quick thinking, as well as games requiring more complicated arithmetic operations. These latter types of games are suitable for many levels of elementary instruction. Thus, the present invention provides several fun and educational games for students at various stages of learning, and provides the teacher with a multipurpose teaching tool.

Accordingly, it is an object of the present invention to provide an improved educational game apparatus.

It is also an object of this invention to provide an educational game apparatus that offers mathematics training for a range of elementary instructional levels.

It is a further object of this invention to provide an educational game apparatus that instructs children about basic mathematical concepts like consecutive ordering and negativity.

Finally, it is an object of this invention to provide an educational game apparatus that offers a wide range of different mathematics games, to maximize the child's interest and enthusiasm.

These and other objects and advantages of the present invention will become more apparent from the detailed description below, when taken in conjunction with the annexed drawings.

DESCRIPTION OF THE PREFERRED EMBODIMENT

Figure 1:
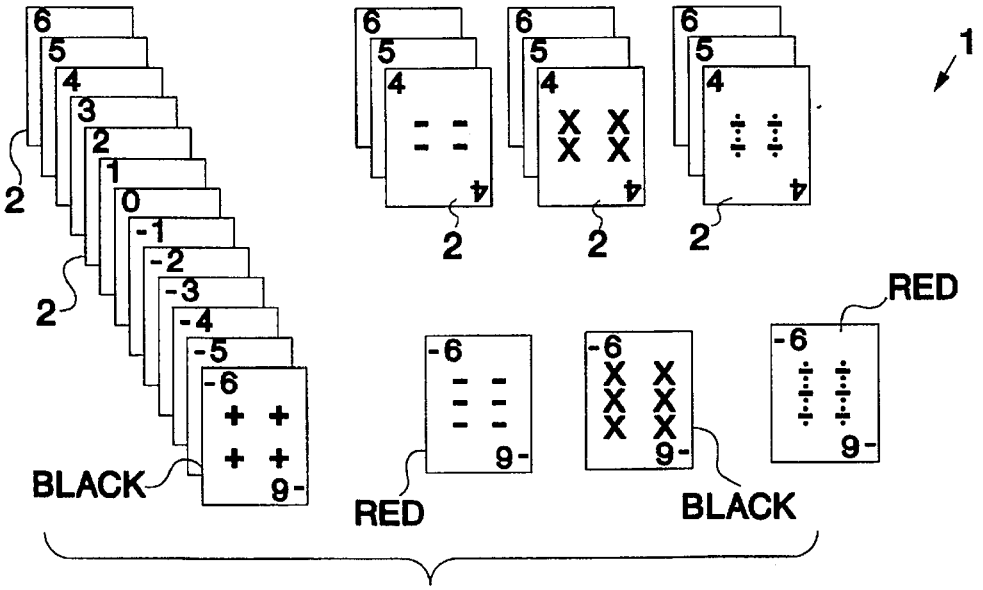
FIG. 1 shows the front faces of the game cards, the deck being divided into four columns to display the equal apportionment of integers, arithmetic operations, and colors within the deck.

Referring now to the drawings in greater detail, the invention 1 shown in FIG. 1 consists of a plurality of playing cards 2, each marked with an integer between −6 and +6, inclusive, with each integer indicated on four of the cards. It can be further seen that the four basic mathematical operations are indicated on the cards (+, −, ×, and ÷), also equally apportioned so that each card contains a different combination of arithmetic operation and integer notation. Finally, as can be seen in FIG. 1 half of the cards contain red notations and half contain black notations (the cards in columns I and 3 contain black notations and the cards in columns 2 and 4 contain red notations). Thus, the deck is similar in configuration to a conventional deck having thirteen numerical values (+6 to −6), four suits (+, −, ×, and ÷), and two colors (red and black). It should be understood that the particular colors are merely for illustration purposes and other colors may be chosen without departing from the scope of the invention.

The cards may be used to play a multitude of mathematically educational games, some of which are described below. Of course, the games described below are by no means the only ones for which the game apparatus of the present invention could be used.

1. MATCHING

The teacher places the cards face down in even rows and instructs the child to choose any two cards, and to keep them if the numerical values match. If they do not match, the cards are returned to their original place. The winner is the one who collects the most pairs. This simple game is designed to teach young children the distinction between positive and negative integers.

2. GREATER OR LESS THAN

The children each choose a card from the deck and compare them. The child with the card indicating the highest value keeps all the cards on that draw, and the one with the most cards at the end of the game wins. This again reinforces the concepts of positive and negative, and numerical value.

3. ADDING; SUBTRACTING; MULTIPLYING; DIVIDING

The players each draw two cards on a given play. The child must perform the operation indicated on the first card with the two integers. The player having the largest numerical solution collects all the cards for that draw, and the winner is the one who has the most cards at the end of the deck. For example, if a player draws a pair denoting (6+,4×), his value for that draw is 10 (adding six and four), but if he draws (4×, 6+), his value would be 24 (multiplying four and six). There are many variations of this game that could be used, depending on the level of instruction. For example, one could simplify the game by requiring only addition of the two numbers, or make it more difficult by increasing the number of cards drawn and requiring the player to perform operations sequentially.

4. INTEGERS

This game, is similar to poker, having a hierarchy of hands that correspond to poker hands. For example, four of the same integer (four of a kind) would win over five consecutive integers (a straight). A hand with consecutive integers in which all the cards contained the same arithmetic operation would be the equivalent of a straight flush, and so on. This game would emphasize concepts of matching, consecutive ordering, and the concepts of positive and negative value.

5. SIX IN THE CORNER

Figure 3:
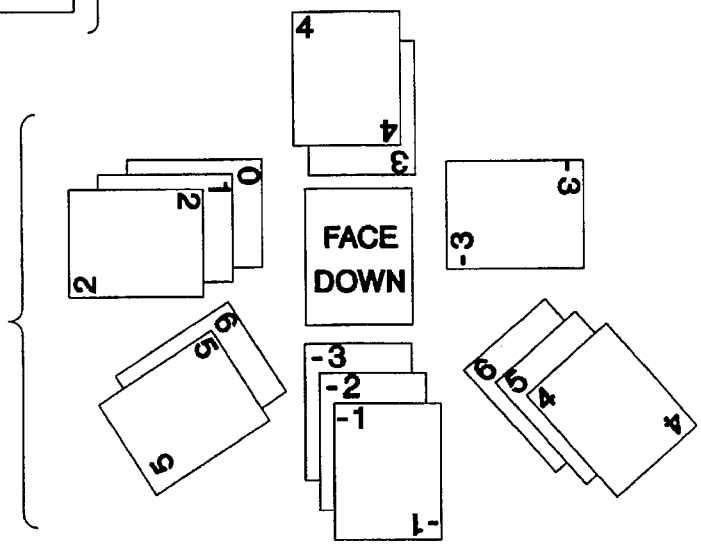

This game, depicted in FIG. 3, reinforces the concept of consecutive ordering. Each player receives five cards face down. The remaining cards are then placed face down in the center, and the top four cards are drawn therefrom and placed face up, surrounding the deck. If any cards so drawn show +6, they are placed face up at the corner of the deck and another card is drawn. The object of the game is to get rid of one's cards by placing them on top of one of the cards that are lying face up in the center. In doing so, however, one can place down only those cards that are consecutive to one of those cards. For example, the only cards which can be placed on top of a (−3) are (−4) or (−2). If a player does not have any cards consecutive with the ones in the center, he must draw a card from the deck until he is able to throw a card. Again, the first player to dispose of all his cards wins. A variation on this game would require that the cards thrown must also alternate colors (i.e., only a red card may be thrown on a black card, and vice versa).

6. SPEED

Figure 2:
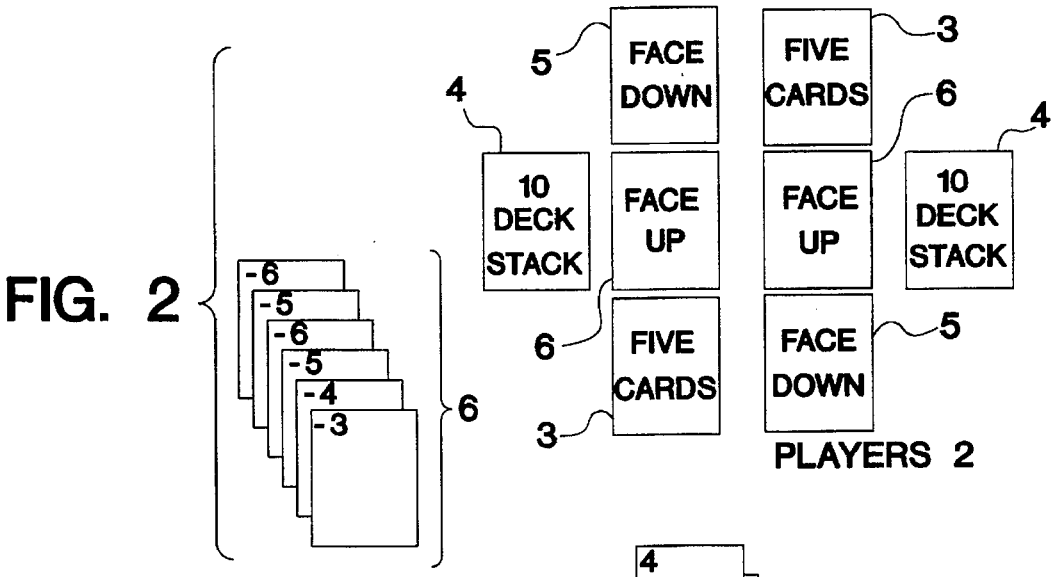
FIGS. 2 and 3 show the placement of the cards as used in various games, described fully below.

The game illustrated in FIG. 2 emphasis increasing and decreasing (consecutive) order of integers. It also requires the players to apply quick thinking skills.

Five cards 3 are dealt to each player and a set of ten cards 4 is placed face down in front of each player on the right side. The remaining cards 5 are divided evenly and distributed to each player. Simultaneously, each player takes one card from the ten card stack 4 and places it face up at 6. Each player quickly begins to place either decreasing or increasing (consecutive) integers on top of either of the cards 6 placed face up. For example, if the card face up is a −5, the player has two options: either place a −4, or a −6 on top of the −5. The order selected can alternate from increasing to decreasing and vice versa. The players can take cards from their deck 3 to continue placing cards down on 6, but at no time can a player hold more than five cards. If neither player has any cards to place down, they simultaneously draw a card from their ten card stack 4, place it face up and continue playing the game. The player who gets rid of all his/her cards first, wins.

The above described games are only illustrative of the wide variety of mathematics related activities that can be devised using the invention, as well as the adaptability of the invention to different instructional levels. The invention thus provides a malleable tool for the teacher to use in maintaining the interest of the students, and in addressing specific needs of students trying to master various basic mathematical concepts.

Although the card game apparatus and the method of using the same according to the present invention are described in the foregoing specification with considerable detail, it is to be understood that modifications may be made to the invention which do not exceed the scope of the appended claims, and modified forms of the invention done by others skilled in the art to which the invention pertains will be considered infringements of this invention when those modified forms fall within the claimed scope of this invention.

What I claim as my invention is:

1. An educational game apparatus comprising:

four sets of cards, each set having integers from +6 through −6 displayed thereon, two of said sets being a first color, and two of said sets being a second color, a first set of said cards having a plus sign thereon, a second set of said cards having a minus sign thereon, a third set of said cards having a multiplication sign thereon, and a fourth set of said cards having a division sign thereon.

* * * * *